US010875142B2

(12) United States Patent
Lin et al.

(10) Patent No.: US 10,875,142 B2
(45) Date of Patent: Dec. 29, 2020

(54) POLISHING PROCESS AND POLISHING APPARATUS FOR GLASS PRODUCT

(71) Applicant: The Coca-Cola Company, Atlanta, GA (US)

(72) Inventors: Yuping Lin, Tucker, GA (US); Fulei Yang, Shandong (CN)

(73) Assignee: The Coca-Cola Company, Atlanta, GA (US)

( * ) Notice: Subject to any disclaimer, the term of this patent is extended or adjusted under 35 U.S.C. 154(b) by 313 days.

(21) Appl. No.: 16/060,496

(22) PCT Filed: Dec. 9, 2016

(86) PCT No.: PCT/CN2016/109156
§ 371 (c)(1),
(2) Date: Jun. 8, 2018

(87) PCT Pub. No.: WO2017/097249
PCT Pub. Date: Jun. 15, 2017

(65) Prior Publication Data

US 2018/0361528 A1 Dec. 20, 2018

(30) Foreign Application Priority Data

Dec. 9, 2015 (CN) ..... 2015 1 0904251

(51) Int. Cl.
*B24B 29/04* (2006.01)
*B24B 1/00* (2006.01)
(Continued)

(52) U.S. Cl.
CPC ..... *B24B 29/04* (2013.01); *B08B 1/04* (2013.01); *B24B 1/00* (2013.01); *B24B 19/006* (2013.01); *B24D 9/003* (2013.01); *B24D 13/04* (2013.01)

(58) Field of Classification Search
CPC ..... B24B 29/04; B24B 1/00; B24B 19/006; B24D 9/003; B24D 13/04; B08B 1/04
See application file for complete search history.

(56) References Cited

U.S. PATENT DOCUMENTS 3,087,283 A 4/1963 Heck et al.
4,009,499 A * 3/1977 Casler ..... B08B 1/04 15/88.3
(Continued)

FOREIGN PATENT DOCUMENTS

CN 103350395 A 10/2013
CN 103481174 A 1/2014
(Continued)

OTHER PUBLICATIONS

International Search Report and Written Opinion, PCT/CN2016/109156, Mar. 17, 2017 (12 pp.).
(Continued)

*Primary Examiner* — Dung Van Nguyen
(74) *Attorney, Agent, or Firm* — Eversheds Sutherland (US) LLP

(57) ABSTRACT

Disclosed are a process and apparatus for polishing a glass article (1201).
The polishing process comprises bringing a rotating article (1201) to be polished into contact with various centrifugally outspread flexible flaps of a rotating flexible flap grinding wheel (1101), with a grinding wheel (1101) rotation shaft being parallel to an article (1201) rotation shaft; and pneumatically controlling the feed of the flexible flap grinding wheel (1101) relative to the surface of the article (1201) to be polished, such that the outer edges of the flaps of the flexible flap grinding wheel (1101) are in pressure contact with the surface to be polished of the article (1201) to be polished, and polishing same. This polishing process can restore a worn glass bottle, particularly a glass bottle having
(Continued)

a profiled contour, to the extent that same looks like new at a lower cost. The corresponding polishing apparatus can realize automatic and continuous grinding polishing of worn glass bottles.

15 Claims, 3 Drawing Sheets

(51) Int. Cl.

| | |
|---|---|
| ***B08B 1/04*** | (2006.01) |
| ***B24B 19/00*** | (2006.01) |
| ***B24D 13/04*** | (2006.01) |
| ***B24D 9/00*** | (2006.01) |

(56) References Cited

U.S. PATENT DOCUMENTS 5,161,281 A * 11/1992 Hanen ..... B08B 1/04 15/88.3
5,655,956 A * 8/1997 Ferreira ..... B24B 1/04 451/143
6,306,015 B1 * 10/2001 Bushell ..... B24B 1/00 451/44
2004/0101680 A1 5/2004 Barber, Jr.

FOREIGN PATENT DOCUMENTS

| | | | |
|---|---|---|---|
| CN | 203680003 | U | 7/2014 |
| CN | 204686633 | U | 10/2015 |
| DE | 72 23 508 | U | 9/1972 |
| EP | 0706841 | A1 | 4/1996 |

OTHER PUBLICATIONS

Abrasives Bürsten Funktionsflächen flexible finishen, Werkstat + Betrieb, Carl Hanser Verlag, Müchen DE, vol. 147, No. 4, pp. 70-72, Apr. 1, 2014 (3 pp.).

* cited by examiner

POLISHING PROCESS AND POLISHING APPARATUS FOR GLASS PRODUCT

TECHNICAL FIELD

The present invention relates to a process and an apparatus for polishing a glass article.

BACKGROUND ART

When distributing beverage products to consumers, the Coca-Cola Company produces in billions of recyclable glass bottles or PET bottles. Other beverage companies, including beer companies, in the beverage industry also produce a large number of recyclable bottles. During filling, shipping and use, wear marks are often formed on contact rings of these bottles, forming wear rings. The presence of wear rings is unacceptable to consumers and may result in consumers abandoning the purchase of the product. In addition, the presence of wear rings can cause increased friction between bottles during filling. During beverage filling on a production line, it is necessary to increase the thrust to maintain the movement of the bottles on the filling line. This increased thrust and stress concentration due to the presence of wear makes it easier for the bottle to break during filling. The increase in the breakage amount of bottles during the filling process on the one hand increases the upfront costs of recovery, transportation and cleaning, and on the other hand also increases the cleaning cost for broken bottles on the filling line. Therefore, eliminating scratches, especially wear rings, from recycled bottles is a problem that must be addressed in order to promote consumer choice and effectively reduce production costs.

The processes and apparatuses for polishing glass articles in the prior art are generally directed at the grinding polishing processing of plate glass. The clamping and working of plate glass are relatively easy, and an ideal grinding polishing effect can be obtained by means of a relatively simple process, with various grinding polishing techniques already having become mature. However, with regard to the grinding polishing processing of irregularly-profiled glass bottles, the prior art cannot satisfy the requirements for the degree of finish of the outer surface of the bottle and the production process requirements, and certain difficulties occur during clamping and working, and the efficiency is low. How to achieve the polishing of a profiled glass article in a continuous and automated manner is a problem that needs to be solved in the industry.

In the prior art, there are two main methods for polishing or removing scratches from glass articles.

One of the methods involves polishing glass bottles using mechanical grinding, which mainly consists of the following types:

1. Polishing using a hard grinding wheel. The hard grinding wheel is composed of a hub and a complex of an abrasive and a binder, with the complex being bonded to the outside of the hub, and grinding wheels of various shapes including a parallel grinding wheel, a double-sided concave grinding wheel, a double bevel grinding wheel, a cylindrical grinding wheel, a dish-shaped grinding wheel and a bowl-shaped grinding wheel. Hard grinding wheels of these shapes are only suitable for use on flat surfaces or for linear grinding and polishing. When the hard grinding wheels are used to treat three-dimensional or profiled bottles, it is necessary to perform a very complex motion control on the grinding wheel, so that the purpose can be achieved. Even with a complex motion control, hard grinding wheels of these shapes still cannot completely match various parts of profiled glass bottles, which affects the final surface polishing effect.

2. Polishing using an abrasive belt. An abrasive belt is a belt-shaped tool, which is useful for grinding and polishing, that is manufactured by bonding an abrasive to a flexible material, such as paper or cloth, using a binder. Abrasive belts are generally suitable for relatively flat surfaces or for linear grinding and polishing. Single linear grinding and polishing methods often leave scratches that are not easily eliminated on the surface of the article to be processed. In addition, abrasive belts are poor in durability and need to be replaced frequently, and it is not easy to realize automated mass production of same.

3. Manual polishing using a manual tool. This method cannot guarantee a uniform polishing quality for large batches of glass bottles, makes it difficult to increase the efficiency and perform up-scaling, and also has high labor costs.

U.S. Pat. No. 1,608,857 discloses a bottle polishing apparatus mainly comprising: a frame body, a polishing drum/wheel made of a fibrous material, such as felt or cloth, that is rotatably supported by the frame body, a guide bar that rotates about the center of the frame body to swing towards or away from the drum, a bottle holding frame, a device for simultaneously rotating the polishing drum and allowing the holding bottle frame to reciprocate, a spring device for driving the guide bar to move towards the polishing drum, a limit stop, etc. Polishing is accomplished by dipping the lower portion of the polishing drum/wheel into a container containing a polishing material consisting of a ground abrasive and water and rotating the bottle. The apparatus can be used to polish large batches of bottles; however, it is difficult to realize the polishing of scratches at specific positions of profiled bottles, and it is also difficult to polish bottles having complicated three-dimensional surfaces. If the desired polishing effect is obtained by prolonging the polishing time, the polishing abrasive is wasted, the polishing efficiency is reduced, and the polishing cost is increased.

WO 1995028255 discloses a method for removing marks from the surface of a bottle. The method eliminates scratches from the surface of the bottle by means of first roughly grinding same with an abrasive having an abrasive grain size of P220-P600, and then finely grinding with an abrasive having an abrasive grain size of at least P1000. In this method, abrasives of different grain sizes are respectively aluminum oxide and pumice carried on flexible belts. This method makes it difficult to precisely control the polishing force applied to the three-dimensional surface of the bottle, so the original shape is easily changed, and it is difficult to realize automatic mass production of same.

Another method involves using a chemical reagent to remove scratches. The chemical reagent method mainly relates to covering scratches on the surface of the bottle with a coating mixture with a special composition or reducing the production of surface scratches by means of an improved cleaning solvent.

European patent application EP 0470442 discloses a coating for traces of wear of glass articles, wherein a mixture comprising several specific types of compounds is used as a coating to cover scratches on a glass article.

Chinese patent application CN 101760129 discloses a method for covering glass scratch marks by using a silicone emulsion mixture.

European patent application EP 1253192 discloses a method for reducing the wear of bottles during washing by improving the composition of recycled glass bottle washing water.

However, the treatment of recycled glass bottles using a chemical method will inevitably result in the addition of a cleaning procedure in the subsequent processes, so as to avoid the possibility of chemicals causing harm to the human body. Therefore, the scope of application of these chemical treatment methods is narrow.

In the prior art, it is believed that abrasives of different materials have different application fields. By way of example, brown fused alumina A is used for grinding carbon steel, alloy steel, malleable cast iron, hard bronze, etc.; black silicon carbide C is used for grinding cast iron, brass, aluminum, refractory materials and non-metallic materials; green silicon carbide GC is used for grinding hard alloys, optical glass, gems, jade, ceramics, etc.; and artificial diamond is used for grinding high hardness materials such as hard alloys and gems. It is mentioned in Chinese patent publication CN 201592394 that flap disks in the prior art are composed of many small abrasive disks formed of silicon carbide, an aluminum oxide abrasive and ordinary abrasive cloth-based fabric layers and wheel centers, and such flap disks are usually used for grinding materials with a lower hardness, such as steel and wood, but cannot be used for grinding materials with a greater hardness, such as stone, glass and ceramics.

Therefore, there is a need to provide a new process which avoids the problems of high costs and high selectivity in the polishing processes in the prior art and realizes bulk polishing with a good uniformity for glass articles, especially for profiled glass articles.

SUMMARY OF THE INVENTION

In order to solve the above-mentioned technical problem, according to one aspect of the present invention, a polishing process is provided, comprising: bringing a rotating article to be polished into contact with various centrifugally outspread flexible flaps of a rotating flexible flap grinding wheel, with a grinding wheel rotation shaft being parallel to an article rotation shaft; and pneumatically controlling the feed of the flexible flap grinding wheel relative to the surface of the article to be polished, such that the outer edges of the flaps of the flexible flap grinding wheel are in pressure contact with the surface to be polished of the article to be polished, and polishing same.

Preferably, said pneumatic controlling of the feed of the flexible flap grinding wheel relative to the surface of said article to be polished is performed by pneumatically applying a force, in the radial direction, to said article rotation shaft by means of said grinding wheel rotation shaft.

Preferably, the feed of said flexible flap grinding wheel relative to the surface of said article to be polished can be automatically compensated by the surface contour of the article to be polished, so that each of the flaps of said flexible flap grinding wheel is in pressure contact with the surface to be polished of the article to be polished at a constant pressure.

Preferably, said grinding wheel rotation shaft can advance and retract, so that the feed of said flexible flap wheel relative to the surface of said article to be polished is automatically compensated by the contour of the article to be polished.

Preferably, the direction of rotation of said grinding wheel rotation shaft is the same as that of the article rotation shaft, but the speed of rotation thereof is different.

Preferably, the speed of rotation of said article rotation shaft is 1-100 r/min, and the speed of rotation of said grinding wheel rotation shaft is 500-3000 r/min. Preferably, the pressure of the pressure contact of the flaps of said flexible flap grinding wheel with the surface to be polished of the product to be polished is 2-6 kgf.

Preferably, the ratio of the length of the flaps to the diameter of the hub of the flexible flap grinding wheel is 1:2 to 1:7, and by rationally selecting the diameter of the hub and the length of the flaps, the contact between the flaps and the article and the service life and replacement frequency of the grinding wheel during continuous large batch polishing can be effectively controlled.

Preferably, said flexible flap grinding wheel comprises a hub and a plurality of flexible flaps with an inner edge fixed on the hub and an outer edge that can be outspread, each flexible flap comprising a substrate and an abrasive layer, and the abrasive layer being bonded to the substrate and comprising an abrasive and a binder. The material and thickness of said substrate are selected as having the same or a similar rate of consumption with respect to said abrasive layer. The hardness of the abrasive is a Mohs hardness of 6-10, and the abrasive is, for example, silicon carbide, aluminum oxide, cerium oxide or artificial diamond. The grain sizes of the abrasive of the flexible flap grinding wheel are roughly the same, and may be selected from, for example, 300-1 μm, respectively. The density of said abrasive layer is, for example, 2.8-4.2 g/cm$^3$. The substrate layer is made of one of various types of cloth and metal wires. The rotating article to be polished is sequentially brought into contact with a plurality of rotating flexible flap grinding wheels in the descending order of the grain sizes of abrasives of the grinding wheels, so as to complete the polishing process for the article to be polished from grinding to polishing. The width of a grinding wheel flap with a smaller abrasive grain size is greater than the width of a grinding wheel flap with a larger abrasive grain size, so as to obtain a better polishing effect.

The article to be polished according to the present invention is preferably a glass article having an axisymmetric structure, e.g., a glass bottle and a profiled glass bottle. Herein, the term "polishing" refers to the processes or steps of grinding, grinding and polishing, and is also sometimes referred to as grinding polishing in this context, and polishing an article using a grinding wheel in the general sense, and by means of the polishing process, the surface to be polished of the article to be polished is given the desired degree of finish. Herein, the flexible flap grinding wheel is also referred to as a centrifugally outspread grinding wheel. According to the present invention, the flexible flap of the rotation grinding wheel is in soft contact with the surface of the rotating article to be polished, such as a glass article, the flexible flaps provide an appropriate intensity of abrasion for the surface to be polished, and the abrasive layer on the flexible flaps eliminates scratches from the surface to be polished without damaging the surface of the glass article and creating new scratches. The inner edges of a plurality of flaps having the same size are mounted on the hub of the grinding wheel, with the width of the flaps also serving as the width of the grinding wheel. The plurality of flaps are preferably mounted on the hub at equal intervals. When the grinding wheel rotates at a high speed along the rotation shaft, the flexible flaps are outspread into an arc under the action of a centrifugal force, and a small portion of the outer end and outer edge of each flap is exposed to the article to be polished. Only the exposed portion of the abrasive layer of the flap is in contact with the surface of the article to be polished, and grinds and polishes the scratches on the article while the abrasive is being consumed. In the present invention, the movement of the grinding wheel towards the article, which is provided pneumatically, makes it possible to keep the outer end and outer edge of the flexible flap of the grinding wheel in close contact with various portions of the glass article without leaving any blind corners during polishing, and makes it possible to control the speed and amount of the feed of the exposed portion of the flap, so that the flap always grinds and polishes various portions of the article and the surfaces of different articles by means of a new edge and an end face, which improves the efficiency of grinding polishing and the uniformity of the grinding polishing effect, and also makes it possible to polish the article to be polished in a bulk and automated manner. Furthermore, the grinding wheel rotation shaft can linearly advance and retract, so that the feed of said flexible flap wheel relative to the surface of said article to be polished is automatically compensated by the contour of the article to be polished. In this way, the outer edge of the flexible flaps of the grinding wheel is in contact with the various positions of the profiled surface of the article to be polished by means of the same contact force, and the various positions of the profiled surface are ground and polished by means of the same contact force and the same abrasive layer, so that the polishing of the profiled surface of the article can be realized with a minimum amount of grinding, thus avoiding the occurrence of protruding portions being significantly ground, recessed portions not being polished and ground, and the wall thickness of the bottle-shaped article being uneven after polishing, and also avoiding the occurrence of bottles shattering caused by stress concentration due to the uneven wall thickness under the action of the thrust force on the filling line.

According to another aspect of the present invention, a polishing apparatus is provided, comprising at least one set of grinding wheel rotation mechanisms, an article rotation mechanism and at least one set of automatic feed compensation mechanisms. Each set of grinding wheel rotation mechanisms comprises a servo motor and a grinding wheel rotation shaft driven by the servo motor, the servo motor and the grinding wheel rotation shaft being fixed on a baseplate. The article rotation mechanism is used for driving an article rotation shaft to rotate, the article rotation shaft being parallel to each grinding wheel rotation shaft. Each set of automatic feed compensation mechanisms comprises: a pneumatic supply for controlling the feed of said grinding wheel rotation shaft relative to the article rotation shaft by means of a pneumatic pressure, and a linear guide rail, with a sliding block on which said baseplate is fixed being capable of moving linearly along the linear guide rail.

The grinding wheel rotation mechanism allows the grinding wheel rotation shaft to rotate, and drives the rotation of the flexible flap grinding wheel thereon, thus allowing the flap to be outspread into an arc under the action of a centrifugal force. The article rotation mechanism allows the article to be polished to rotate in the same direction as that of the grinding wheel, and the outer surface of the bottle is in contact with the end and the outer edge of the flexible flaps of the rotating grinding wheel, and is thus polished. The automatic feed compensation mechanism is used for keeping the outspread flaps of the flexible flap grinding wheel in continuous contact with the rotating surface to be polished, and for controlling the speed and amount of the feed, and thus controlling the intensity of the grinding and polishing of the flaps of the grinding wheel on the surface of the article being polished, so that the surface of an article, such as a glass bottle, is uniformly polished. The sliding block on the linear guide rail can allow the grinding wheel rotation shaft which is fixed on the sliding block to get close to the article being polished under the push of the pneumatic supply or to move away from the article being polished at a protruding portion of the surface contour of the article being polished, so that the force applied to the surface being polished can be kept substantially constant by means of the automatic compensation of the surface contour of the article being polished. Preferably, the force applied by the flaps of the grinding wheel to the surface of the article to be polished is about 2-6 kgf. The polishing apparatus may further comprise a grinding wheel control mechanism for controlling the opening and closing of the flaps of the flexible flap grinding wheel. An automatic electric or pneumatic control assembly can be used to control the opening and closing of the flaps of the grinding wheel, etc.

Preferably, the polishing apparatus further comprises an automatic article loading and unloading mechanism and an automatic article conveying mechanism. The article loading and unloading mechanism can load or unload an article at any stage of the process and at any stage between processes, e.g., loading a glass article to be polished and unloading a glass article that has been polished. The automatic article conveying mechanism is used for automatically transferring an article to a specified polishing position. The rotating article is polished in a specified position by means of the rotating flexible flap grinding wheel.

Preferably, the apparatus further comprises a cooling system for cooling the flexible flap grinding wheel. Said cooling system is preferably cooling water. During polishing of the glass article using the flexible flap grinding wheel, continuously rinsing the flexible flap grinding wheel and using cooling water to polish the surface on the one hand keeps the grinding wheel at a lower temperature, and on the other hand, flushes the abrasive material falling off of the grinding wheel into the cooling water, which cooling water can be recycled continuously after the abrasive is separated from same.

The present invention has the following beneficial effects:

1. The present invention is useful for polishing complicated or irregular three-dimensional or profiled glass articles having rings and grooves, particularly glass bottles having rings and grooves. According to the method of the present invention, by using a pneumatic auto-compensating grinding wheel feeding method, using a flexible flap grinding wheel as a grinding and polishing tool and using a plurality of polishing steps with different abrasive grain sizes, a worn glass bottle is polished, achieving high-quality polishing with a minimum amount of bottle surface grinding, and maximally retaining the original structure and the thickness of the glass bottle.

2. The process and apparatus according to the present invention realize automated, high-quality, high-uniformity and high-efficiency polishing of bulk glass bottles, and the polished glass packaging articles can increase the consumers' impression of the brand and the satisfaction of consumers, making it possible to recycle a large number of used glass bottles, and thereby significantly saving on the cost of purchasing new bottles and reducing the consumption of raw materials and energy sources.

3. According to the process of the present invention, the glass article can be polished using a silicon carbide abrasive, and a satisfactory surface effect is obtained. Compared with the existing processes, the method according to the present invention markedly reduces the cost of recycling glass bottles.

4. The flexible flap grinding wheel used in the present invention has an abrasive layer and a substrate layer which can be used for running the grinding polishing process multiple times, can achieve a satisfactory surface effect by means of the minimized removal of material from the glass article, allowing the glass article to retain its original geometry, and can increase efficiency. Since the grinding amount is significantly smaller than the existing amount of polishing and grinding for profiled glass bottles, and the consumption of the abrasive of the abrasive layer of the flap is also significantly smaller than that of the conventional abrasive consumption, the frequency of replacement of the grinding wheel can be reduced, making continuous production possible.

5. The process for grinding and polishing glass bottles of the present invention can be directly applied, by incorporation, to existing filling production lines, and the polishing apparatus according to the present invention is arranged before the filling equipment and automatically and continuously polishes packaging bottles before filling, so that the pressure of pushing the glass bottles to advance on the filling production line can be reduced and the rate of breakage of the glass articles is reduced.

BRIEF DESCRIPTION OF THE DRAWINGS

The particular embodiments of the present invention will be further described below in detail in conjunction with the drawings.

DETAILED DESCRIPTION OF EMBODIMENTS

In order to more clearly illustrate the present invention, the present invention will be further described below in conjunction with the preferred embodiments and the accompanying drawings. A person skilled in the art should understand that the following contents which are described in detail are illustrative rather than limiting, and should not thus limit the scope of protection of the present invention.

Figure 1:
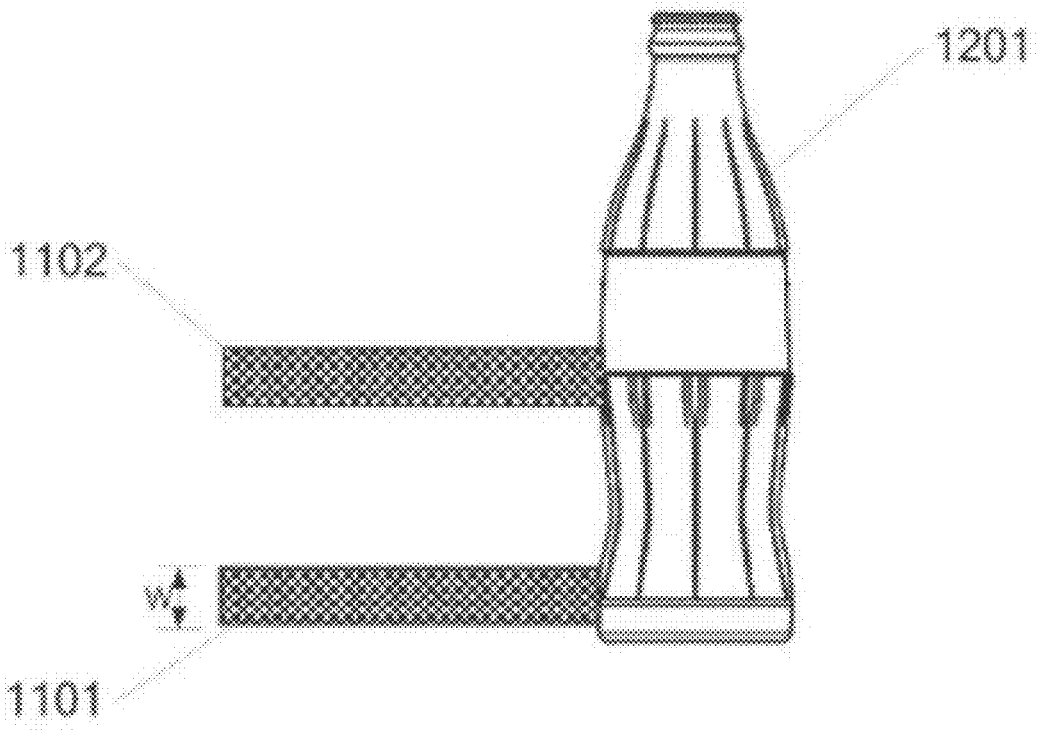
FIGS. 1 and 2 are schematic views of the flexible flap grinding wheel of the present invention when in contact with a glass bottle.
Figure 2:
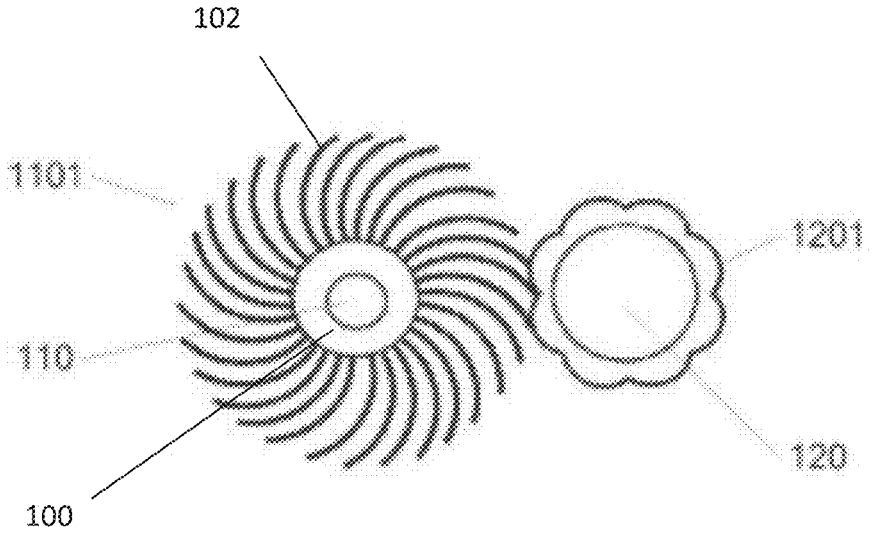

FIGS. 1 and 2 show a schematic view of the process for grinding and polishing a glass bottle using a flexible flap grinding wheel according to the present invention.

As shown in the figures, the flexible flap grinding wheel 1101 comprises a hub 100 and a plurality of flexible flaps 102. Each flexible flap comprises a substrate and an abrasive layer, the abrasive layer being bonded to the substrate and comprising an abrasive and a binder. The substrate is a flexible material and may be, for example, a cloth, a non-woven fabric or a metal, or an organic high molecular material, etc. The abrasive layer comprises an abrasive and a binder. The hardness of the abrasive is a Mohs hardness of 6-10, and the abrasive may be, for example, silicon carbide, aluminum oxide, cerium oxide or artificial diamond. The abrasive of the flexible flap grinding wheel is abrasive grains with a grain size that is selected from 300-1 μm, and may respectively be, for example, but are not limited to, 150-180 μm, 35-40 μm, 20-25 μm, 15-20 μm, or 10-13 μm, and the density of the abrasive layer is 2.8-4.2 g/cm3. The inner edge of the flexible flap is fixed on the hub, and the installation interval between the flaps is preferably constant. Flaps on the same grinding wheel are preferably the same size. A small portion of the outer edge of and the end face of each flap are exposed when the grinding wheel is rotating in the rotation direction, and the exposed portion is in contact with the surface of the article to be polished and thus polishes the surface of the article. With regard to an article 1201 to be polished which has a complicated structure, such as a ring and a groove, or a glass article which has an irregular three-dimensional or profiled shape, the flexible flaps of the grinding wheel are outspread under the centrifugal action of rotation, so that the outer edge thereof can reach each portion of the surface of the article and thus polishes same. The material and thickness of the substrate and the material and thickness of the abrasive layer are chosen to have the same or a similar rate of consumption with respect to said abrasive layer. In this case, the material of the substrate is ground off with the grinding of the abrasive, which, on the one hand, ensures the uniformity of the grains of the abrasive layer which are in contact with the surface of the article being polished, and on the other hand, avoids the risk of the abrasive failing to be in uniform contact with the surface of the article to be polished or even the grinding wheel shaft or the article shaft stopping rotating due to the fact that the material of the substrate has been wound around the grinding wheel shaft or the article shaft for an extremely long time.

As shown in the figures, the grinding wheel rotation shaft 110 for allowing the flexible flap grinding wheel to rotate and the article rotation shaft 120 for allowing the article 1201 to be polished to rotate are arranged in parallel to each other, and the grinding wheel rotation shaft and the article rotation shaft rotate in the same direction, e.g., clockwise. The speed of rotation of the article rotation shaft is, for example, 1-100 r/min, and the speed of rotation of the grinding wheel rotation shaft is, for example, 500-3000 r/min. At the position of the contact between the flaps and the article, the flaps and the article move toward each other. Under the centrifugal action of the high-speed rotation, the outer edge of the flaps moves away from the grinding wheel rotation shaft, and thus tangentially grinds the article. By using this flexible flap grinding method, abrasive grains falling off during grinding can be taken away from the article being polished, thus avoiding the phenomenon of the abrasive grains emerging during hard grinding wheel grinding and being embedded in the polished article, so that the polishing effect can be effectively improved. In order to bring the portion of the outer edge of the surface of the flaps, which is exposed to the article, into full contact with the surface of the article, the present invention involves pneumatically applying a force, in the radial direction, to the article shaft by means of said grinding wheel rotation shaft, so that the flaps of the grinding wheel are in pressure contact with the surface to be polished of the article to be polished. The radial force not only brings the outer edge of the flaps into full contact with the outer surface of the article to be polished, but also results in radial grinding of the article, which facilitates effectively removing deeper scratches which exist on the surface of the article, thereby significantly improving the grinding efficiency. The rotating article to be polished is sequentially brought into contact with a plurality of grinding wheels with different abrasive grain sizes in the descending order of the grain sizes of abrasives of these grinding wheels, so as to complete the polishing process from grinding to polishing for the surface of the article to be polished. The width W of the flaps of these wheels may be the same or different. According to a preferred embodiment of the present invention, the smaller the grain size of the abrasive grains of the flaps of each grinding wheel, the greater the width of the flaps, i.e., the width of the flaps of the grinding wheel, which is the first to polish the article to be polished, is the narrowest, and the width of the flaps of the flap grinding wheel used in the next polishing procedure is greater than the width of the flaps of the grinding wheel in the previous polishing procedure. In this way, while grinding and polishing the scratches of the article to be polished, the next polishing procedure polishes the grinding traces that may be generated by the grinding wheel in the previous polishing procedure, finally resulting in a polished article with a surface that is as smooth, bright and clean as if it were new.

In the present invention, a force is applied pneumatically by means of the grinding wheel shaft, so that the flexible flaps of the grinding wheel are in pressure contact with the outer surface of the article, and the loss of the flaps is compensated by the feed of the grinding wheel shaft to ensure that the speed and amount of feeding of the exposed portions of the flaps are constant. Where the article to be polished has a profiled outer surface having grooves, in particular having axially extending grooves, if the outer edge of the grinding wheel is only pneumatically brought into pressure contact with the surface of the article and the force provided by the pneumatic supply is kept constant, the pressure of the flaps exerted on a protruding portion of the outer surface of the article to be polished and the contact area thereof are greater than the pressure exerted on a recessed portion of the surface of the article and the contact area thereof as the article rotates. If the constant power value is too large, excessive grinding polishing of the protruding portion of the outer surface may be caused, reducing the thickness of part of the wall of a thin-walled article such as a glass bottle, and resulting in the shape of the bottle body being changed or the strength thereof being reduced. If the constant power value is too small, the outer edge of the flaps cannot reach the recessed portion due to the presence of the protruding portion of the article to be polished, resulting in the recessed portion not being polished, which affects the polishing effect. According to a preferred embodiment of the flexible flap according to the present invention, the flexible flap can be bent and deformed so that the pressure exerted on the surface of the article is automatically compensated by the appearance of the article, causing each portion of the flap to be in contact with the surface of the article at similar pressures for uniform polishing of the surface of the article, whereby a polished product with a smooth surface can be obtained.

Figure 3:
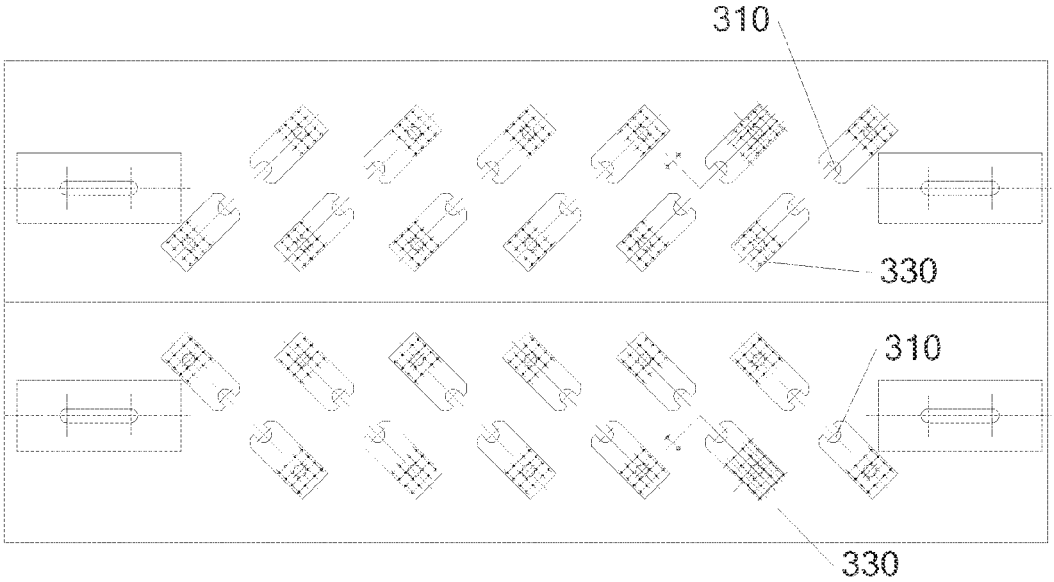
FIGS. 3 and 4 are schematic views of a production line of the polishing apparatus according to the present invention.
Figure 4:
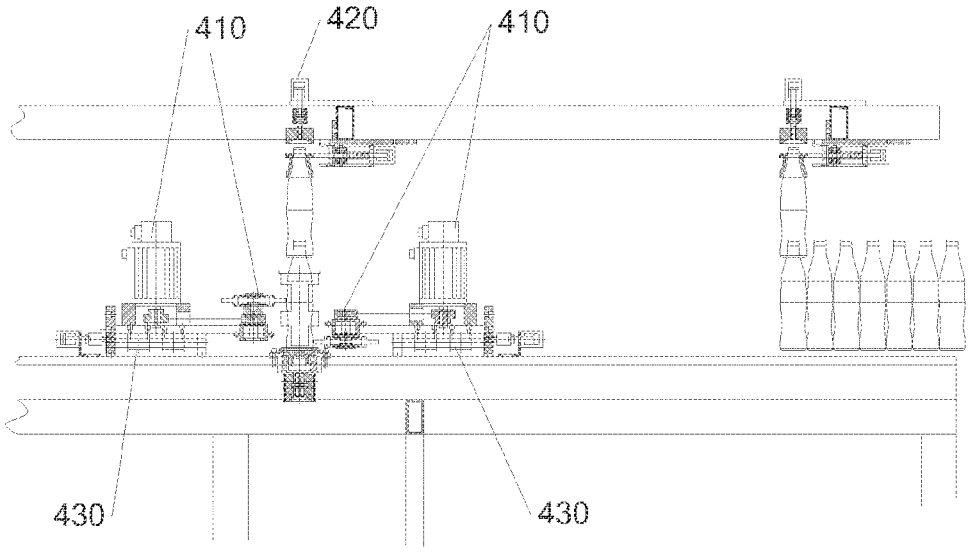
Figure 5:
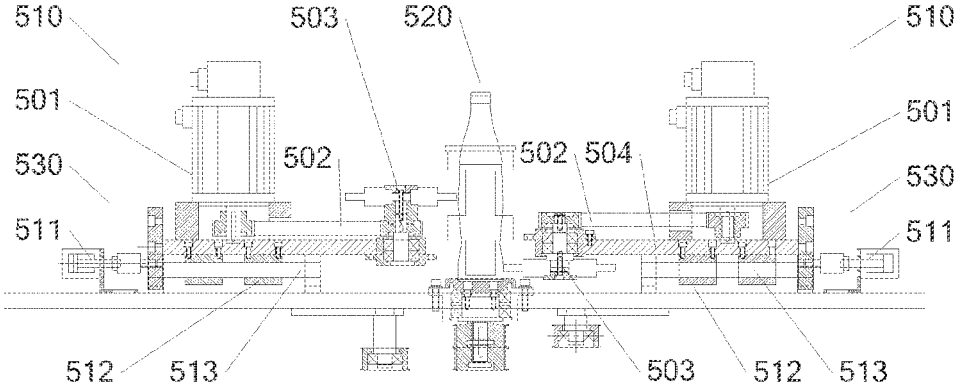
FIG. 5 is a partial schematic view of the polishing apparatus according to the present invention.

The present invention further provides an automated continuous polishing apparatus, as shown in FIGS. 3-5, for polishing articles such as glass bottles to be polished. The polishing apparatus comprises at least one set of grinding wheel rotation mechanisms 310, 410, 510, an article rotation mechanism 420, 520, an automatic feed compensation mechanism 430, 530, an automatic article loading and unloading mechanism and an automatic article conveying mechanism. Each set of grinding wheel rotation mechanisms 510 comprises a servo motor 501, a grinding polishing motor multi-wedge belt 502 and a grinding wheel rotation shaft 503. The grinding polishing servo motor is connected with the grinding wheel rotation shaft via a multi-wedge belt, and is used for driving the grinding wheel rotation shaft to rotate. One or more flexible flap grinding wheels may be arranged axially on each grinding wheel rotation shaft. A plurality of grinding wheels are arranged at different heights to perform grinding polishing on different positions of the article, and as shown in FIG. 1, two grinding wheels are arranged on one grinding wheel rotation shaft, or multiple grinding wheels are stacked to increase the grinding wheel width for polishing the article (not shown). The grinding polishing servo motor and the grinding wheel rotation shaft are fixedly mounted on a fixation baseplate 504, without any relative movement between the two. The automatic feed compensation mechanism comprises a gas cylinder 511 and a linear guide rail 513 equipped with a linear bearing or sliding block 512. The gas cylinder pushes the fixation baseplate on which the grinding polishing servo motor and the grinding wheel rotation shaft are mounted, so that the grinding wheel rotation shaft thereon is fed toward the article rotation shaft, and the exposed outer edge of the flaps of the flexible flap grinding wheel is in pressure contact with the surface to be polished. By controlling the gas pressure of the gas cylinder, the speed and amount of feeding of the grinding wheel on the grinding wheel rotation shaft can be controlled. By respectively controlling the speed of rotation of the grinding wheel rotation shaft and the speed of rotation of the article rotation shaft, the intensity of the abrasion can be controlled for the polishing of the surface of the article. The linear bearing or sliding block 512 integrally supporting the servo motor and the rotation shaft can linearly move back and forth along the linear guide rail. During polishing, the force provided by the gas cylinder brings the outer edge of the flexible flaps into pressure contact with the outer surface of the article via the grinding wheel rotation shaft, and since the grinding wheel can move linearly, the grinding wheel driven by the gas source cylinder as the power advances and retreats according to the contour of the outer surface of the article, keeping the contact force and the contact area at which the flaps are in contact with different positions of the surface of the glass bottle constant, and achieving the same grinding polishing effect at different positions of an article having a profiled structure, which effectively solves the problem of uneven grinding of various glass bottles with different circumferential sizes. The automatic feed compensation mechanism according to the present invention has a simple structure, a good stability and a low cost, which makes it possible to carry out standardized grinding polishing processing of profiled articles, and can result in a polished article with a neat and highly uniform appearance. The article rotation mechanism according to the present invention drives the article rotation shaft, causing the article located thereon to rotate. In the method of the present invention, the article rotates simultaneously with the grinding wheel, so that a uniform polished surface can be obtained. Preferably, the article loading and unloading mechanism of the present invention, for example, having an automated mechanical arm opening-closing-type loading and unloading structure for automatically loading and unloading the article to be polished, further comprises a beam work station moving switching mechanism which is capable of moving and switching the loaded glass article between work stations, and the automatic article conveying mechanism can convey the article to be polished to multiple different polishing work stations where the surface of the article is sequentially ground and polished by means of flexible flap grinding wheels of different grain sizes to realize the polishing of the surface of the article. According to one embodiment of the present invention, the grinding wheel rotation mechanism may be located on one side of the article rotation shaft, and two or more flexible flap grinding wheels located at different heights of the grinding wheel rotation shaft can perform grinding polishing on different positions of the article, as shown in FIG. 1. According to another embodiment of the present invention, two or more grinding wheel rotation mechanisms may be oppositely arranged about the rotation shaft for the article to be polished, as shown in FIGS. 3 to 5, and may respectively drive the grinding wheel rotation shafts to allow the grinding wheels thereon to perform grinding polishing on different positions of the article. The polishing apparatus according to the present invention further comprises a cooling mechanism for cooling the flexible flap grinding wheel. For the cooling system, water is preferably used as the cooling medium, or a polishing liquid comprising an abrasive and water is used as the cooling medium. During polishing of the glass article using the flexible flap grinding wheel, continuously rinsing the flexible flap grinding wheel and the surface being polished using a cooling medium on the one hand cools the grinding wheel, and on the other hand, flushes the abrasive material falling off of the grinding wheel away from the surface being ground and polished, so as to ensure the polishing quality. After the spent cooling medium is collected and the abrasive material is separated from the water, the medium can be continuously recycled.

With the polishing apparatus of the present invention and the polishing process according to the present invention, continuous automated high-quality polishing of glass bottles is made possible.

Example 1

By means of flexible flap grinding wheels using commercially available epoxy resin binder silicon carbide sandpapers of respective models of #80, #320 and #800 as flexible flaps, glass bottles are ground and polished with different contact forces using the polishing process according to the present invention, and the resulting grinding results are as shown in following table.

| Abrasive | Grain size | Porosity | Contact force | Grinding effect | Flap service life |
|---|---|---|---|---|---|
| Silicon carbide | #80 | Low | 6 kgf | Good | The flap can be used continuously for a long time |
| Silicon carbide | #320 | High | 2 kgf | Poor | The service life of the flap is short |
| Silicon carbide | #800 | Low | 4 kgf | Good | The flap can be used continuously for a long time |

It can be seen that a silicon carbide abrasive with an epoxy resin as the main binder can be used for polishing glass articles. Polishing a glass article by selecting an appropriate contact grinding force and using flaps with an abrasive layer having a low porosity can result in a good grinding polishing effect, and the service life of the flap is long. When the article is ground and polished with a smaller contact grinding force using high-porosity flaps, the grinding polishing effect is not good, the abrasion loss of the abrasive of the flap is great, and the service life is short. A person skilled in the art would understand that the material and grain size of the abrasive and the density of the abrasive layer of the grinding wheel can be selected according to the material and the degree of wear of the article to be polished. For example, flexible flaps of different abrasive grain sizes, such as about 300 μm, about 200 μm, about 160 μm, about 155 μm, about 50 μm and several micrometers, are used for the rough grinding, medium grinding and fine grinding of bottles, and silicon carbide powder is finally used for polishing. The pressure of the pressure contact of the flaps of said flexible flap grinding wheel with the surface to be polished of the product to be polished is controlled to be 2-6 kgf. Specifically, by means of controlling the pressure of the gas source that provides the feed power and by means of the action of the centrifugal force on the flaps due to the high-speed rotation of the grinding wheel rotation shaft, the contact force between the flaps and the glass bottle and the polishing effect can be controlled. From this example, it can be seen that low-cost silicon carbide can be effectively used for polishing glass.

Example 2

The process for polishing a glass article according to the present invention will be specifically described with reference to Example 2 below. The glass article is sequentially polished using six flexible flap grinding wheels of different abrasive grain sizes. In this example, the diameter of the hub of each flexible flap grinding wheel is 150 mm, the ratio of the length of the flaps to the diameter of the hub is 1:6, and the length of the flaps is 25 mm. The widths of the first to sixth flaps are respectively 8 mm, 10 mm, 12 mm, 15 mm, 18 mm and 19 mm, and the substrate material of the flexible flaps is a fabric. The flaps of the first to fifth grinding wheels are flexible flaps in which the abrasives in the abrasive layers are silicon carbide and the grain sizes are respectively, for example, about 300 μm, about 200 μm, about 160 μm, about 155 μm, and about 50 μm. The abrasive of the flaps of the sixth grinding wheel is cerium oxide, and the grain size is about 1 μm. By using a binder comprising an epoxy resin and talcum powder, abrasive grains form an abrasive layer and adhere to the substrate, with the density of the abrasive layer being about 3.2 g/cm$^3$. During the grinding process, the grinding wheel rotation shaft and the article rotation shaft rotate clockwise in the same direction. The speed of each article rotation shaft is 23 r/min. The speeds of rotation of the first to sixth grinding wheel rotation shafts are respectively 800 r/min, 1000 r/min, 1200 r/min, 1600 r/min, 1800 r/min, and 2000 r/min. By controlling the gas source pressure of the gas cylinder, the force applied to bring the outer edge of the flexible flaps onto the article is controlled to be 2-6 kgf, and the forces of the flaps of the first to sixth grinding wheels in this example are respectively about 4 kgf; said flexible flap grinding wheel is kept in contact with the surface to be polished of the glass article, and an appropriate intensity of abrasion is applied to the surface to be polished.

Obviously, the above-mentioned embodiments of the present invention are merely examples for clearly illustrating the present invention, rather than for limiting the embodiments of the present invention. For a person of ordinary skill in the art, on the basis of the above description, other variations or changes in different forms may also be made, it is impossible to exhaustively provide all the embodiments herein, and any obvious variation or change derived from the technical solution of the present invention is still within the scope of protection of the present invention.

The invention claimed is:

1. A polishing process comprising:

bringing a rotating article to be polished into contact with various centrifugally outspread flexible flaps of a rotating flexible flap grinding wheel, with a grinding wheel rotation shaft being parallel to an article rotation shaft; and pneumatically controlling the feed of the flexible flap grinding wheel relative to the surface of the article to be polished, such that the outer edges of the flaps of the flexible flap grinding wheel are in pressure contact with the surface to be polished of the article to be polished, and polishing same.

2. The polishing process of claim 1, wherein said pneumatic controlling of the feed of the flexible flap grinding wheel relative to the surface of said article to be polished is performed by pneumatically applying a force, in the radial direction, to said article rotation shaft by means of said grinding wheel rotation shaft.

3. The polishing process of claim 1, wherein the feed of said flexible flap grinding wheel relative to the surface of said article to be polished can be automatically compensated according to the surface contour of the article to be polished, so that each of the flaps of said flexible flap grinding wheel is in pressure contact with the surface to be polished of the article to be polished at a constant pressure.

4. The polishing process of claim 3, wherein said grinding wheel rotation shaft can advance and retract, so that the feed of said flexible flap wheel relative to the surface of said article to be polished is automatically compensated by the contour of the article to be polished.

5. The polishing process of claim 1, wherein the direction of rotation of said grinding wheel rotation shaft is the same as that of the article rotation shaft, but the speed of rotation thereof is different.

6. The polishing process of claim 1, wherein the speed of rotation of said article rotation shaft is 1-100 r/min, and the speed of rotation of said grinding wheel rotation shaft is 500-3000 r/min.

7. The polishing process of claim 1, wherein the pressure of the pressure contact of the flaps of said flexible flap grinding wheel with the surface to be polished of the product to be polished is 2-6 kgf.

8. The polishing process of claim 1, wherein said flexible flap grinding wheel comprises a hub and a plurality of flexible flaps with an inner edge fixed on the hub and an outer edge that can be outspread, each flexible flap comprising a substrate and an abrasive layer, and the abrasive layer being bonded to the substrate and comprising an abrasive and a binder.

9. The polishing process of claim 8, wherein the material of said substrate is selected as having the same or a similar rate of consumption with respect to said abrasive layer.

10. The polishing process of claim 8, wherein the process further comprises bringing the rotating article to be polished sequentially into contact with a plurality of rotating flexible flap grinding wheels in the descending order of the grain sizes of abrasives of the grinding wheels, where the width of a grinding wheel flap with a smaller abrasive grain size is greater than the width of a grinding wheel flap with a larger abrasive grain size.

11. The polishing process of claim 10, wherein the abrasive grain size of each of said plurality of flexible flap grinding wheels is selected from 300-1 μm.

12. The polishing process of claim 1, wherein the abrasive of the flexible flap grinding wheel is selected from abrasives with a Mohs hardness of 6-10.

13. The polishing process of claim 1, wherein the abrasive of the flexible flap grinding wheel is selected from silicon carbide, aluminum oxide, diamond or cerium oxide.

14. The polishing process of claim 1, wherein said article to be polished is a glass article.

15. A polishing apparatus comprising:

at least one set of grinding wheel rotation mechanisms, each set of grinding wheel rotation mechanisms comprising a servo motor and a grinding wheel rotation shaft driven by the servo motor;

an article rotation mechanism for driving an article rotation shaft to rotate, said article rotation shaft being parallel to each grinding wheel rotation shaft; and at least one set of automatic feed compensation mechanisms, wherein said servo motor and said grinding wheel rotation shaft are fixed on a baseplate; and wherein each set of automatic feed compensation mechanisms comprises:

a pneumatic supply for controlling the feed of said servo motor and said grinding wheel rotation shaft relative to the article rotation shaft by means of pneumatic pressure, and a linear guide rail, with a sliding block on which said baseplate is fixed being capable of moving linearly along the linear guide rail.

* * * * *